US007129921B2

(12) United States Patent
Yeon et al.

(10) Patent No.: US 7,129,921 B2
(45) **Date of Patent: *Oct. 31, 2006**

(54) GRAY VOLTAGE GENERATION CIRCUIT FOR DRIVING A LIQUID CRYSTAL DISPLAY RAPIDLY

(75) Inventors: Yeun-Mo Yeon, Seoul (KR); Kun-Bin Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 128 days.

This patent is subject to a terminal disclaimer.

(21) Appl. No.: 10/747,665

(22) Filed: Dec. 30, 2003

(65) Prior Publication Data

US 2005/0083285 A1 Apr. 21, 2005

Related U.S. Application Data

(63) Continuation of application No. 09/956,146, filed on Sep. 20, 2001, now Pat. No. 6,670,935.

(30) Foreign Application Priority Data

Dec. 21, 2000 (KR) ..... 2000-79698

(51) Int. Cl.
*G09G 3/36* (2006.01)

(52) U.S. Cl. ..... 345/89; 345/92; 345/96; 345/99

(58) Field of Classification Search ..... 345/87–104, 345/690–691, 204, 208–210
See application file for complete search history.

(56) References Cited

U.S. PATENT DOCUMENTS

| | | | | |
|---|---|---|---|---|
| 5,945,970 | A * | 8/1999 | Moon et al. | 345/92 |
| 6,118,421 | A | 9/2000 | Kawaguchi et al. | 345/89 |
| 6,310,592 | B1 | 10/2001 | Moon et al. | 345/87 |
| 6,556,180 | B1 | 4/2003 | Furuhashi et al. | 345/87 |
| 6,567,062 | B1 | 5/2003 | Kudo et al. | 345/92 |
| 6,844,867 | B1 * | 1/2005 | Yamada | 345/99 |

* cited by examiner

*Primary Examiner*—Lun-yi Lao

(57) ABSTRACT

A gray voltage generation circuit for driving a liquid crystal display rapidly outputs an altered gray voltage so that a source driving circuit can charge liquid crystal capacitors constructed in a liquid crystal panel in a short period of time. In response to the gray voltages from the gray voltage generation circuit, while driving a positive polarity, the source driving circuit generates a liquid crystal driving voltage of higher level than the existing liquid crystal driving voltage when applying a gate clock signal of high level, and generates a liquid crystal driving voltage of a level similar to the existing liquid crystal driving voltage when applying a gate clock signal of low level. And, while driving a negative polarity, the source driving circuit generates a liquid crystal driving voltage of lower level than an existing liquid crystal driving voltage when applying a gate clock signal of high level, and generates a liquid crystal driving voltage of a level similar to the existing liquid crystal driving voltage when applying a gate clock signal of low level.

13 Claims, 13 Drawing Sheets

GRAY VOLTAGE GENERATION CIRCUIT FOR DRIVING A LIQUID CRYSTAL DISPLAY RAPIDLY

This application is continuation of Ser. No. 09/956,146 filed Sep. 20, 2001 now U.S. Pat. No. 6,670,935.

FIELD OF THE INVENTION

The present invention relates to a liquid crystal display and, more particularly, to a gray voltage generation circuit for driving a liquid crystal display and such a liquid crystal display.

BACKGROUND OF THE INVENTION

Generally, a liquid crystal is an organic compound having a neutral property between liquid and crystal, and changes in its color or transparency by voltage or temperature. A liquid crystal display (LCD), which expresses information using the liquid crystal, occupies a smaller volume and has a lower power consumption than a conventional display device. Therefore, lots of attentions are paid to the LCD as a novel display device.

FIG. 1 schematically illustrates a configuration of a conventional liquid crystal display. A liquid crystal display 10 includes a liquid crystal panel 1, a gate driving circuit 2 coupled to the liquid crystal panel 1, a source driving circuit 3, a timing control circuit 4, and a gray voltage generation circuit (or gamma reference voltage generation circuit) 5.

The liquid crystal panel 1 is made of a plurality of gate lines G0 through Gn and a plurality of data lines D1 through Dm that are vertically interconnected with the gate lines, respectively. The gate driving circuit 2 is connected to each of the gate lines G0 through Gn, and the source driving circuit 3 is connected to each of the data lines D1 through Dm. One pixel is composed in each interconnection of the gate lines and the data lines. Each pixel is made of one thin film transistor (TFT), one storing capacitor Cst, and one liquid crystal capacitor Cp. Each of pixels composing the liquid crystal panel 1 further includes three sub-pixels corresponding to red (R), green (G), and blue (B). A pixel displayed via the liquid crystal panel 1 is obtained by combination of R, G, and B color filters. The liquid crystal display 10 can display not only color pictures but also pure red, green, blue, and gray scales by combining those pixels.

The timing control circuit 4 issues control signals (e.g., gate clock and gate on signals) required in the gate driving circuit 2 and the source driving circuit 3 in response to color signals R, G, and B, horizontal and vertical synch signals HSync and Vsync, and a clock signal CLK. The gray voltage generation circuit 5 is connected to the source driving circuit 3, generating a gray voltage Vgray or a gamma reference voltage that is a reference to generate a liquid crystal driving voltage Vdrive. One example of the gray voltage generation circuit 5 is disclosed in U.S. Pat. No. 6,067,063 entitled "LIQUID CRYSTAL DISPLAY HAVING A WIDE VIEW ANGLE AND METHOD FOR DRIVING THE SAME", issued to Kim et al., issued on May 23, 2000. A gray voltage generation circuit 5 disclosed therein includes a plurality of resisters R1 through Rn+1 that are directly coupled between a power supply voltage (Vcc) and a ground (GND). Each of the resisters R1 through Rn+1 distributes the power supply voltage (Vcc) with a predetermined ratio, generating n-bit gray voltages VG1 through VGn.

Now, operations of the liquid crystal display 10 having such a configuration will be described in detail. If the gate driving circuit 2 sequentially scans pixels of the panel row by row, the source driving circuit 3 generates a liquid crystal driving voltage Vdrive based upon the color signals R, G, and B inputted through the timing control circuit 4, in response to the reference voltage Vgray outputted from the gray voltage generation circuit 5. And then, the source drive 3 applies the generated voltage Vdrive to the panel 1 each time of scanning.

In such an operation, the TFT acts as a switch. For example, when the TFT is turned on, the liquid crystal capacitor Cp is charged by the liquid crystal driving voltage Vdrive generated from the source driving circuit 3. When the TFT is turned off, the capacitor Cp prevents the charged voltage from leaking. This shows that the liquid crystal driving voltage Vdrive applied from the source driving circuit 3 has a great influence upon driving each TFT composing the panel 1.

As the liquid crystal display tends to implement high speed response, it is required to enhance a response speed of such a liquid crystal display Cp in order to speed up the device. This is because if the voltage Vdrive applied from the source driving circuit 3 has a high value, the capacitor Cp would quickly be charged to enhance a total driving speed of a liquid crystal display.

There are many methods of boosting a liquid crystal driving voltage Vdrive applied from the source driving circuit 3 in order to enhance a driving speed of the liquid crystal display. For example, it requires a design change of the gate driving circuit 2 or the source driving circuit to generate a liquid crystal driving voltage Vdrive of high level, or a design change of the timing control circuit 4 for issuing a control signal to the driving circuits 2 and 3. Unfortunately, changing designs of such high-priced circuits causes higher costs in a production unit. Furthermore, the increased liquid crystal driving voltage Vdrive also increases power consumption of the liquid crystal display in proportion to the voltage Vdrive rise.

Accordingly, the object of the present invention is to overcome the foregoing drawbacks, and to provide a gray voltage generation circuit that can enhance a driving speed of a liquid crystal display with low cost and power consumption.

SUMMARY OF THE INVENTION

To attain this object, there is provided a liquid crystal display that includes a liquid crystal panel having a plurality of pixels, a gray voltage generation circuit for generating a plurality of gray voltages corresponding to data to be displayed in the liquid crystal panel, a timing control circuit for issuing a gate clock signal and a plurality of control signals, a gate driving circuit for sequentially scanning the pixels row by row in response to the gate clock signal, and a source driving circuit for generating a liquid crystal driving voltage in response to the data and applying the generated liquid crystal driving voltage to the panel each time of scanning. In response to the gray voltage, the source driving circuit generates a liquid crystal driving voltage that has different values in high and low level intervals.

DESCRIPTION OF THE PREFERRED EMBODIMENT

A new and improved gray voltage generation circuit of a liquid crystal display is provided to the present invention. The gray voltage generation circuit generates a high-potential liquid crystal driving voltage for a predetermined interval so that liquid crystal capacitors may be charged in a short time, and alters and outputs a gray voltage after the predetermined interval in order to generate a normal liquid crystal driving voltage. As a result, a driving speed of the liquid crystal display can be enhanced.

Figure 1:
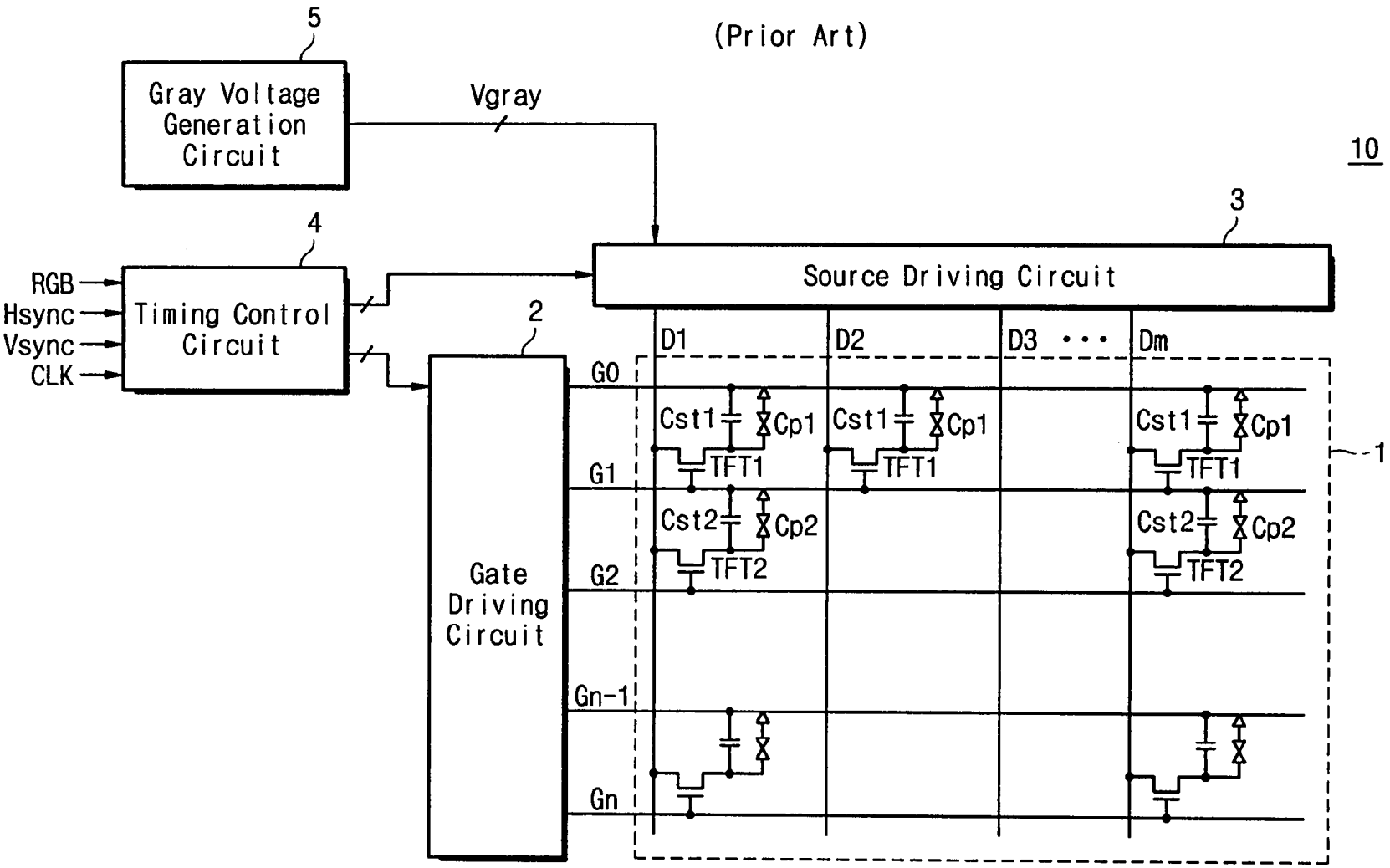
Fig. 1 (Prior Art)
FIG. 1 is a block diagram showing a configuration of a conventional liquid crystal display.
Figure 2:
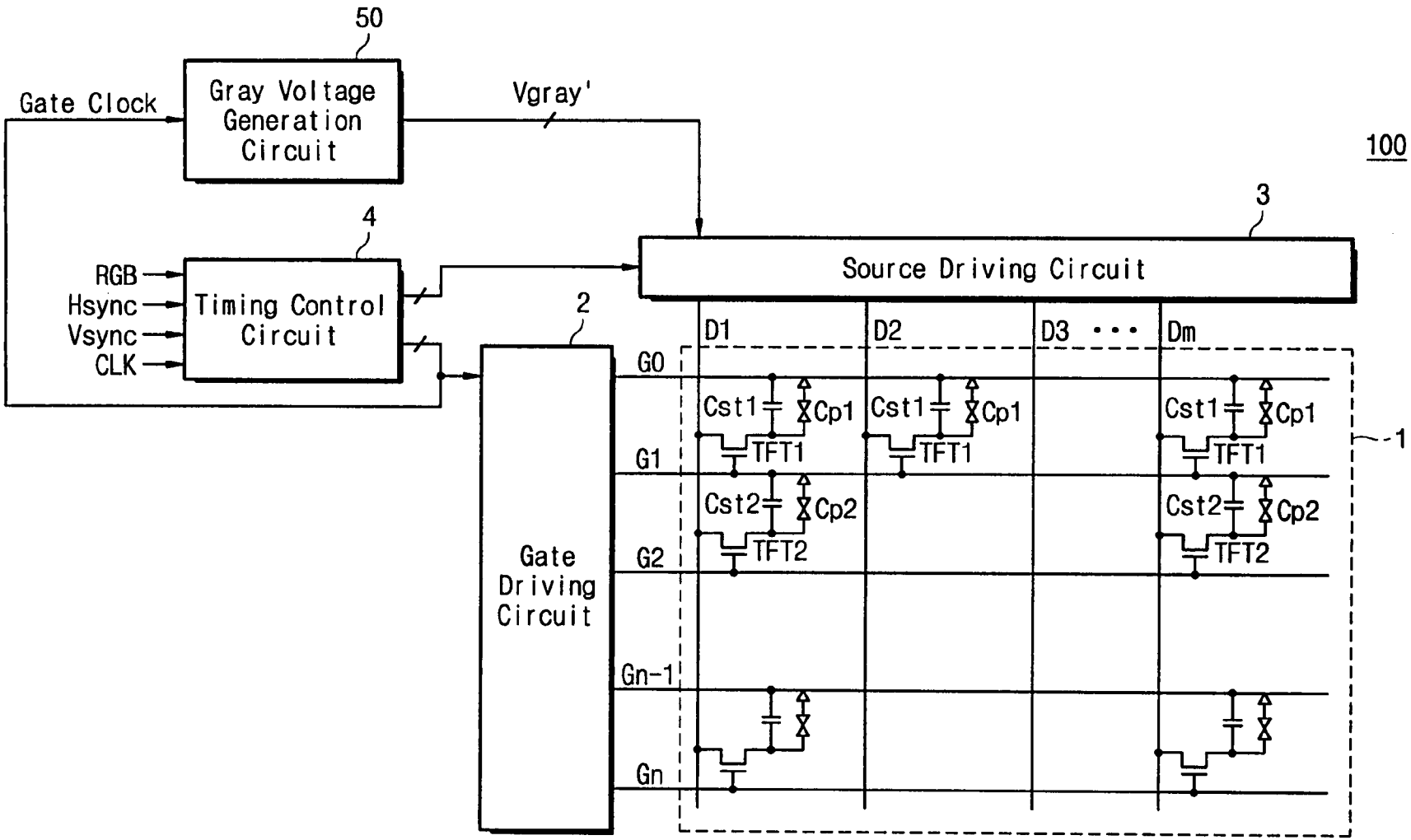
FIG. 2 is a block diagram showing a configuration of a liquid crystal display in accordance with the present invention.

FIG. 2 schematically illustrates a configuration of a liquid crystal display 100 according to the present invention. The liquid crystal display 100 includes a liquid display panel 1, a plurality of gate driving circuits 2 coupled to the panel 1, a plurality of source driving circuits 3, a timing control circuit 4, and a gray voltage generation circuit 50. Such a configuration is identical to the configuration of the conventional liquid crystal display shown in FIG. 1, except for a gray voltage generation circuit 50 for generating a gray voltage Vgray' in response to a gate clock signal Gate Clock issued from a timing control circuit. Same numerals denote same elements throughout the drawings, and their description will be skipped herein so as to avoid duplicate description.

It is well known that the source driving circuit 3 selects one of a plurality of gray voltages according to color signals (R, G, and B), and applies a liquid crystal driving voltage Vdrive to a liquid crystal panel in response to the selected one gray voltage. A function of the source driving circuit 3 is closely bound up with a charging speed of the liquid crystal display Cp constructed in the liquid crystal panel 1. The liquid crystal driving voltage Vdrive is dependent upon the gray voltage Vgray' generated from the gray voltage generation circuit 50. Therefore, a liquid crystal display 100 of the invention changes a liquid crystal driving voltage Vdrive generated from the source driving circuit 3 so as to enhance a charging speed of the liquid crystal capacitor Cp constructed in the panel 1. Without modifying designs of expensive and complex circuits such as the gate driving circuit 2, the source driving circuit 3, and the timing control circuit 4, a gray voltage generation circuit 50 of much lower price than the above circuits is made to enhance a driving speed of the liquid crystal display 100.

Figure 3:
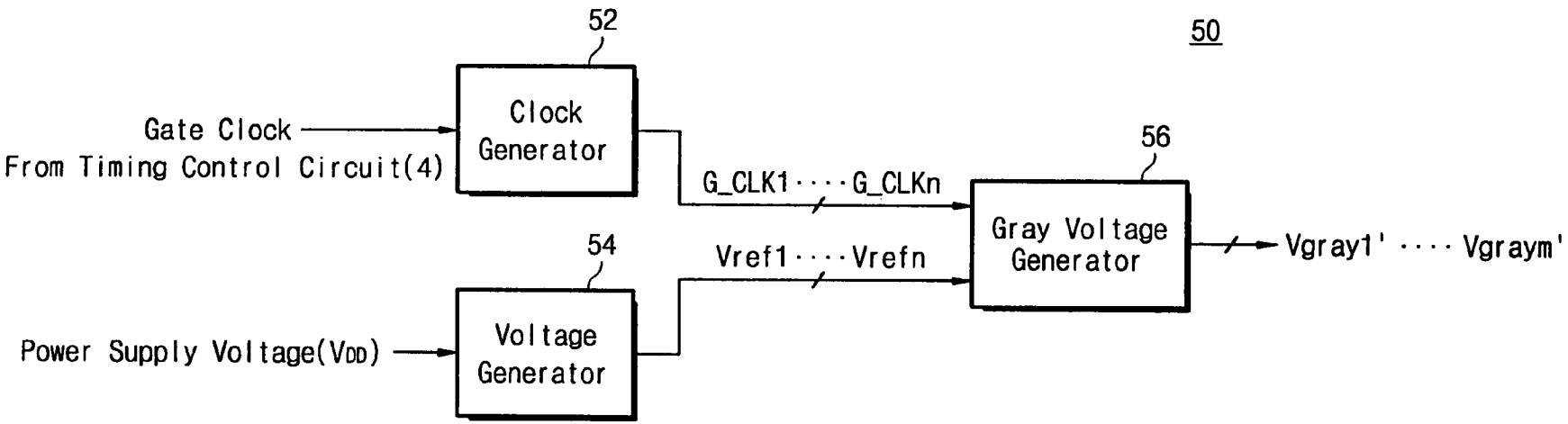
FIG. 3 is a block diagram showing a configuration of a gray voltage generation circuit in accordance with the present invention.

FIG. 3 schematically illustrates a configuration of a gray voltage generation circuit according to the present invention. A gray voltage generation circuit 50 includes a clock generator 52, a voltage generator 54, and a gray voltage generator 56. The clock generator 52 generates n-bit clock signals G_CLK1, . . . , and G_CLKn that are not overlapped with each other, in response to a gate clock signal GATE CLOCK. The voltage generator 54 generates n-bit reference voltages Vref1, . . . , and Vrefn each having different level, in response to a power supply voltage $V_{DD}$ that is an analog signal and is used as a power supply voltage of a source driving circuit 3.

If the n-bit clock signals G_CLK1, . . . , and G_CLKn and the n-bit reference voltages Vref1, . . . , and Vrefn are inputted to the gray voltage generator 56, the gray voltage generator 56 generates m-bit gray voltages Vgray1', . . . , and Vgraym' that are synchronized with the clock signals G_CLK1, . . . , and G_CLKn to have different potentials based upon levels of the reference voltages Vref1, . . . , and Vrefn. Although described in detail hereinbelow, the gray voltages Vgray1', . . . , and Vgraym' makes the source driving circuit 3 generate a liquid crystal driving voltage Vdrive' that has different values in high and low intervals of the clock signal CLOCK during one period of the gate clock GATE CLCK. The liquid driving voltage Vdrive' of the source driving circuit 3 having such a characteristic can enhance a driving speed of a liquid crystal display 100.

Figure 4:
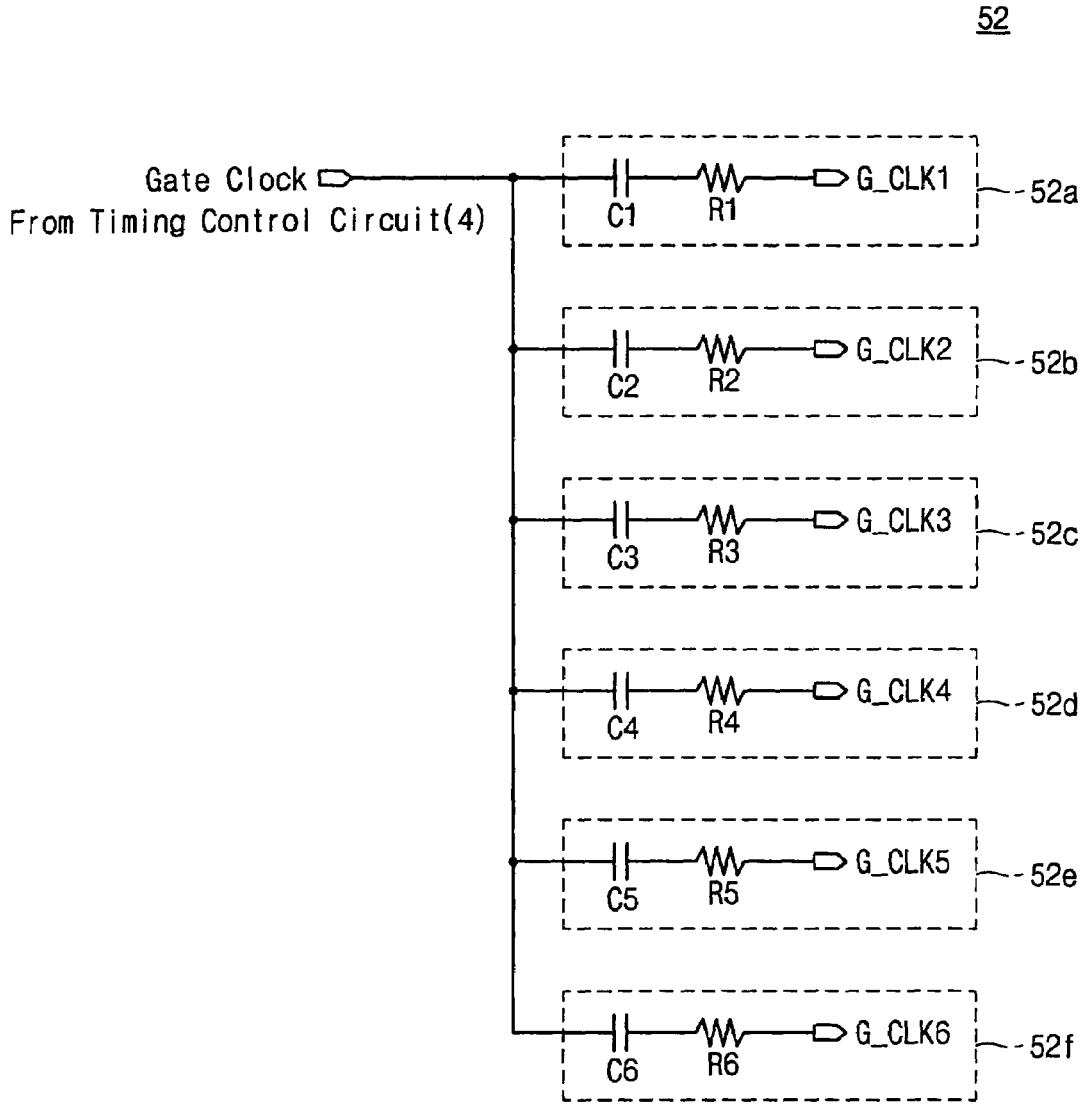
FIG. 4 is a circuit diagram showing a detailed configuration of a clock generator shown in FIG. 3.
Figure 5:
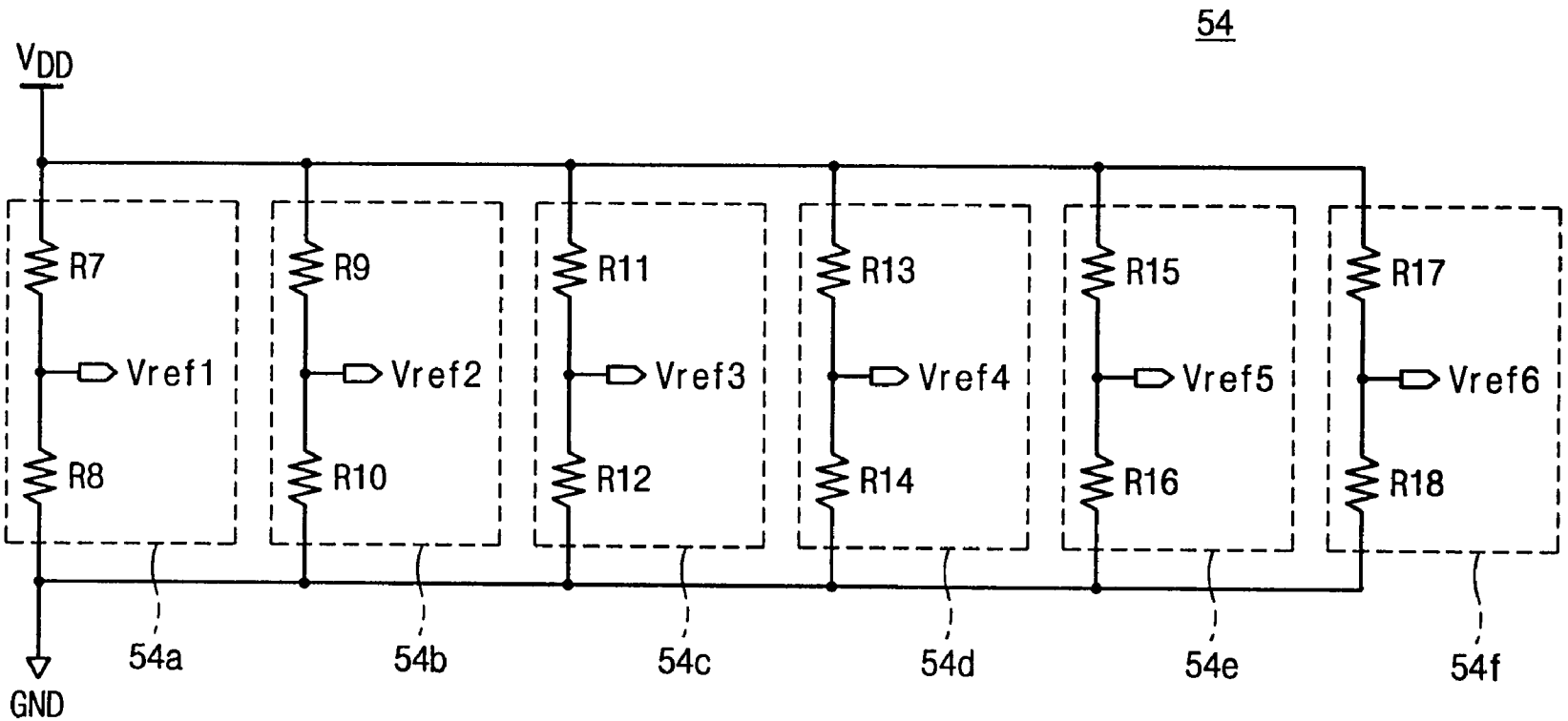
FIG. 5 is a circuit diagram showing a detailed configuration of a voltage generator shown in FIG. 3.
Figure 6:
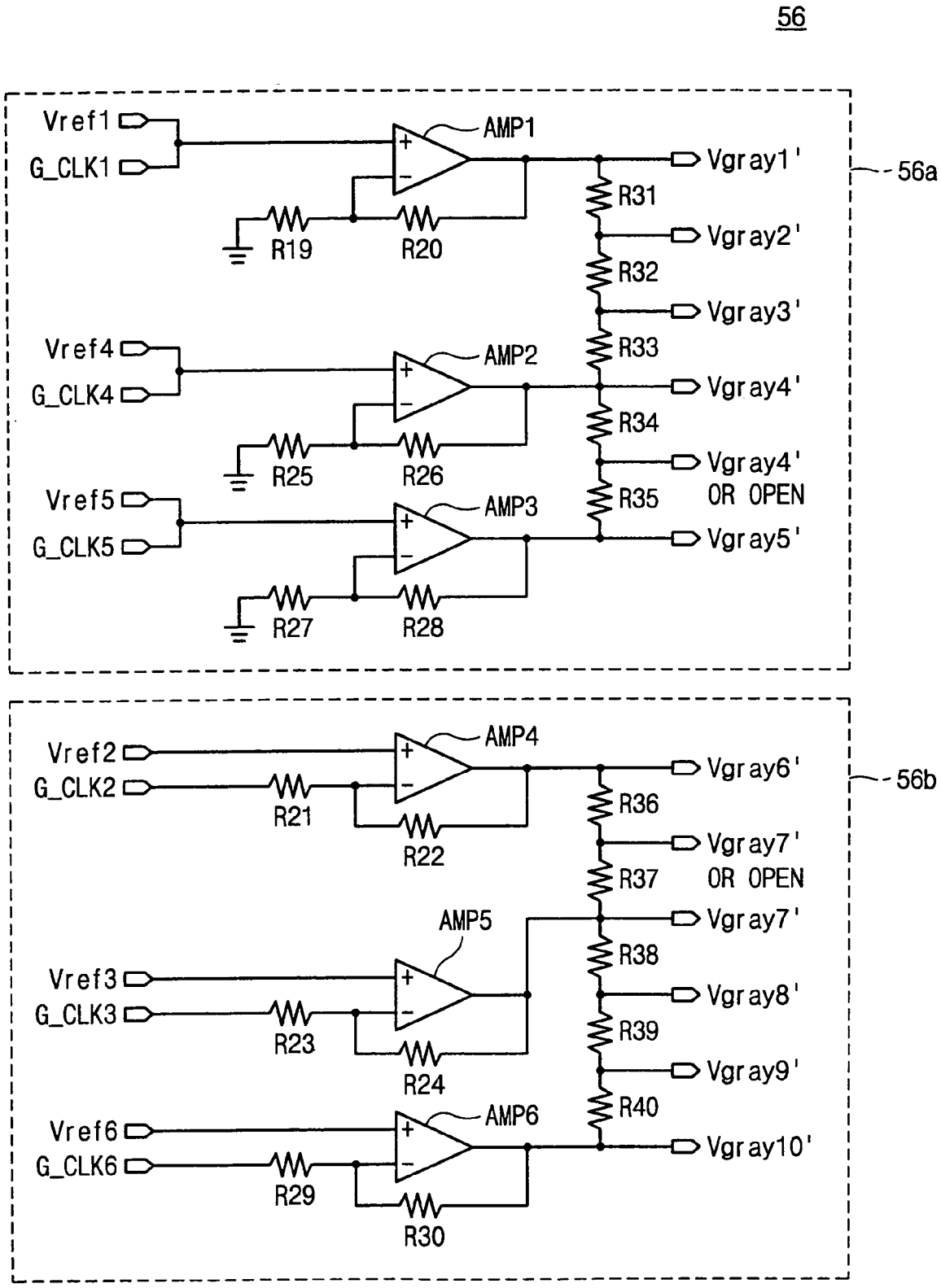
FIG. 6 is a circuit diagram showing a detailed configuration of a gray voltage generation circuit shown in FIG. 3.

FIGS. 4, 5 and 6 illustrate the clock generator 52, the voltage generator 54, and the gray voltage generator 56 that are shown in FIG. 3, respectively. The clock generator 52 issues six clock signals C_CLK1, . . . , and C_CLK6. The voltage generator 54 generates six reference voltages Vref1, . . . , and Vref6. And, the gray voltage generator 56 generates ten clock signals G_CLK1', . . . , and G_CLK10' in response to the six clock signals C_CLK1, . . . , and C_CLK6 and the six reference voltages Vref1, . . . , and Vref6. According to a circuit configuration, the number of generated signals can be changed. The circuits shown in the drawings are merely one example of the circuit configuration.

Referring now to FIG. 4, the clock generator 52 consists of an input terminal for receiving a gate clock signal GATE CLOCK generated from the timing control circuit 4, first and sixth clock generation units 52*a*–52*f* each being coupled to the input terminal in parallel, and first and sixth output terminals each being coupled to the units 52*a*–52*f*. Each of the units 52*a*–52*f* has a capacitor C1, . . . , or C6 and a resister R1, . . . , or R6 that are serially connected between the input terminal and the output terminal. And, each of the units 52*a*–52*f* outputs first and sixth clock signals G_CLK1, . . . , and G_CLK6 not to be overlapped with each other. A period of the clock signals G_CLK1, . . . , and G_CLK6 is identical to that of the gate clock signal GATE CLOCK generated from the timing control circuit 4.

Referring to FIG. 5, the voltage generator 54 consists of six voltage generation units 54*a*–54*f* for generating six reference voltages Vref1, . . . , and Vref6 by dividing a power supply voltage $V_{DD}$ at a predetermined ratio to generate six reference voltages of different levels. The units 54*a*–54*f* are connected between the power supply voltage $V_{DD}$ and a ground voltage GND in parallel. Each of the units 54*a*–54*f* includes two resisters serially connected between VDD and GND, and an output terminal coupled to a contact point between the resisters.

Referring to FIG. 6, the gray voltage generator 56 consists of first and second gray voltage generation units 56*a* and 56*b*. The first gray voltage unit 56*a* generates first to fifth gray voltages Vgray1', . . . , and Vgray5' that are used to drive a positive polarity of a liquid crystal. The second gray voltage unit 56*b* generates sixth to tenth gray voltages Vgray6', . . . , and Vgray10' that are used to drive a negative polarity of a liquid crystal.

The first gray voltage unit 56*a* includes first to sixth input terminals for receiving clock signals G_CLK1, G_CLK4, and G_CLK5 generated from a clock generator 52 and reference voltages Vref1, Vref4, and Vref5 generated from a voltage generator 54. It also includes a first amplifier AMP1, a second amplifier AMP2 and a third amplifier AMP3 for respectively adding and amplifying G_CLK1, G_CLK4, and G_CLK5 to a predetermined ratio to generate gray voltages Vgray1', Vgray4', and Vgray5', and output terminals for outputting Vgray1', Vgray4', and Vgray5'. The first amplifier circuit AMP1 adds G_CLK1 to Vref1, and amplifies it to a predetermined ratio to generate Vgray1'. The second amplifier circuit AMP2 adds G_CLK4 to Vref4, and amplifies it to a predetermined ratio to generate Vgray4'. And, the third amplifier circuit AMP3 adds G_CLK5 to Vref5, and amplifies it to a predetermined ratio to generate Vgray5'.

The gray voltages Vgray1', Vgray4', and Vgray5' are given by the following equations;

$$Vgray1' = \frac{R19 + R20}{R19}\left[Vref1 + \frac{R1}{R1 + R19}V_{G_CLK1}\right] \quad \text{<Equation 1>}$$

$$Vgray4' = \frac{R25 + R26}{R25}\left[Vref4 + \frac{R4}{R4 + R25}V_{G_CLK4}\right] \quad \text{<Equation 2>}$$

$$Vgray5' = \frac{R27 + R28}{R27}\left[Vref5 + \frac{R5}{R5 + R27}V_{G_CLK5}\right] \quad \text{<Equation 3>}$$

wherein $V_{G_CLKn}$ represents an alternative element of a gate clock signal GATE CLOCK.

The first gray voltage generation unit 56*a* generates second and third gray voltages Vgray2' and Vgray3', as well as Vgray1', Vgray4', and Vgray5'. These gray voltages Vgray2' and Vgray3' have the level of a voltage that is divided by resisters R31, R32, and R33 that are serially connected between output terminals of the first and second amplifier circuit AMP1 and AMP2.

The second gray voltage generation unit 56*b* includes seventh to twelfth input terminals for receiving clock signals G_CLK2, G_CLK3, and G_CLK6 generated from the clock generator 52 and reference voltages Vref2, Vref3, and Vref6 generated from the voltage generator 54. It also has a fourth amplifier AMP4, a fifth amplifier AMP5, and a sixth amplifier AMP6 for subtracting G_CLK2, G_CLK3, and G_CLK6 from Vref2, Vref3, and Vref6 to generate gray voltages Vgray6', Vgray8', and Vgray10', and output terminals for outputting Vgray6', Vgray8', and Vgray10' generated from AMP4, AMP5 and AMP6. The fourth amplifier circuit AMP4 subtracts G_CLK2 from Vref2, and amplifies it to a predetermined ratio to generate Vgray6'. The fifth amplifier circuit AMP5 subtracts G_CLK3 from Vref3, and amplifies it to a predetermined ratio to generate Vgray8'. And, the sixth amplifier circuit AMP6 subtracts G_CLK6 from Vref6, and amplifies it to a predetermined ratio to generate Vgray10'.

The gray voltages Vgray6', Vgray8', and Vgray10' are given by the following equations;

$$Vgray6' = \frac{R2 + R21 + R22}{R22}\left[Vref2 - \frac{R22}{R2 + R21}V_{G_CLK2}\right] \quad \text{<Equation 4>}$$

$$Vgray8' = \frac{R3 + R2 + R24}{R24}\left[Vref3 - \frac{R24}{R3 + R23}V_{G_CLK3}\right] \quad \text{<Equation 5>}$$

$$Vgray10' = \frac{R6 + R29 + R30}{R30}\left[Vref6 - \frac{R30}{R6 + R29}V_{G_CLK6}\right] \quad \text{<Equation 6>}$$

wherein $V_{G_CLKn}$ represents an alternative element of the gate clock signal GATE CLOCK.

The second gray voltage generation unit 56*b* generates eighth and ninth gray voltages Vgray8' and Vgray9', as well as Vgray6', Vgray7', and Vgray10'. These gray voltages Vgray8' and Vgray9' have the level of a voltage that is divided by resisters R38, R39, and R40 that are serially connected between output terminals of the fifth and the sixth amplifier circuit AMP5 and AMP6.

In the drawings, the fourth and seventh gray voltages Vgray4' and Vgray7' can be outputted through one or two terminals. For example, the fourth gray voltage Vgray4' generated through a fourth output terminal indicates that it uses an output of the second amplifier circuit AMP2 naturally. And, the fourth gray voltage Vgray4' generated through a fifth output terminal indicates that it divides the output of the second amplifier circuit AMP2 through a resister to a predetermined ratio for output. Based upon a circuit configuration, the gray voltages Vgray1', . . . , and Vgray10' generated from the gray voltage generator 56 may use an output of an amplifier circuit naturally, or may divide and use the output of the amplifier circuit to a predetermined rate. Although Vgray4' and Vgray7' are illustrated in the drawing, they are simply examples. This can be applied to any other gray voltages.

Figure 7A:
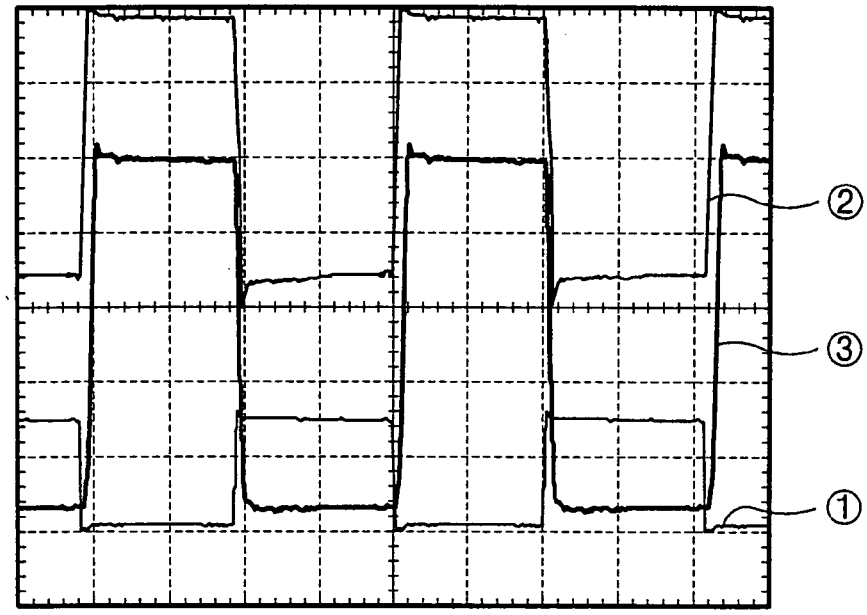
FIGS. 7A and 7B are waveform diagrams showing one example of waveforms of gray voltages that are generated from a gray voltage generation circuit in accordance with the present invention.
Figure 7B:
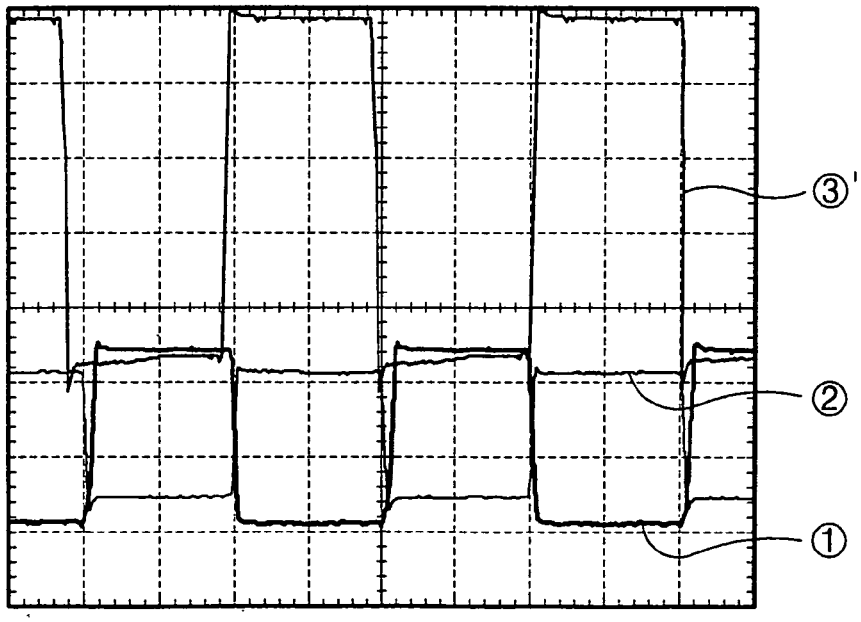

FIGS. 7A and 7B exemplarily illustrate waveforms of gray voltages generated from a gray voltage generation according to the present invention. In particular, FIG. 7A shows a waveform of a gray voltage of a positive polarity, and FIG. 7B shows a waveform of a gray voltage of a negative polarity. Waveforms ① and ①', ② and ②', and ③ and ③' denote a gate clock signal GATE CLOCK issued from a timing control circuit 4, a 48-gray voltage, and a 64-gray voltage, respectively.

Figure 8:
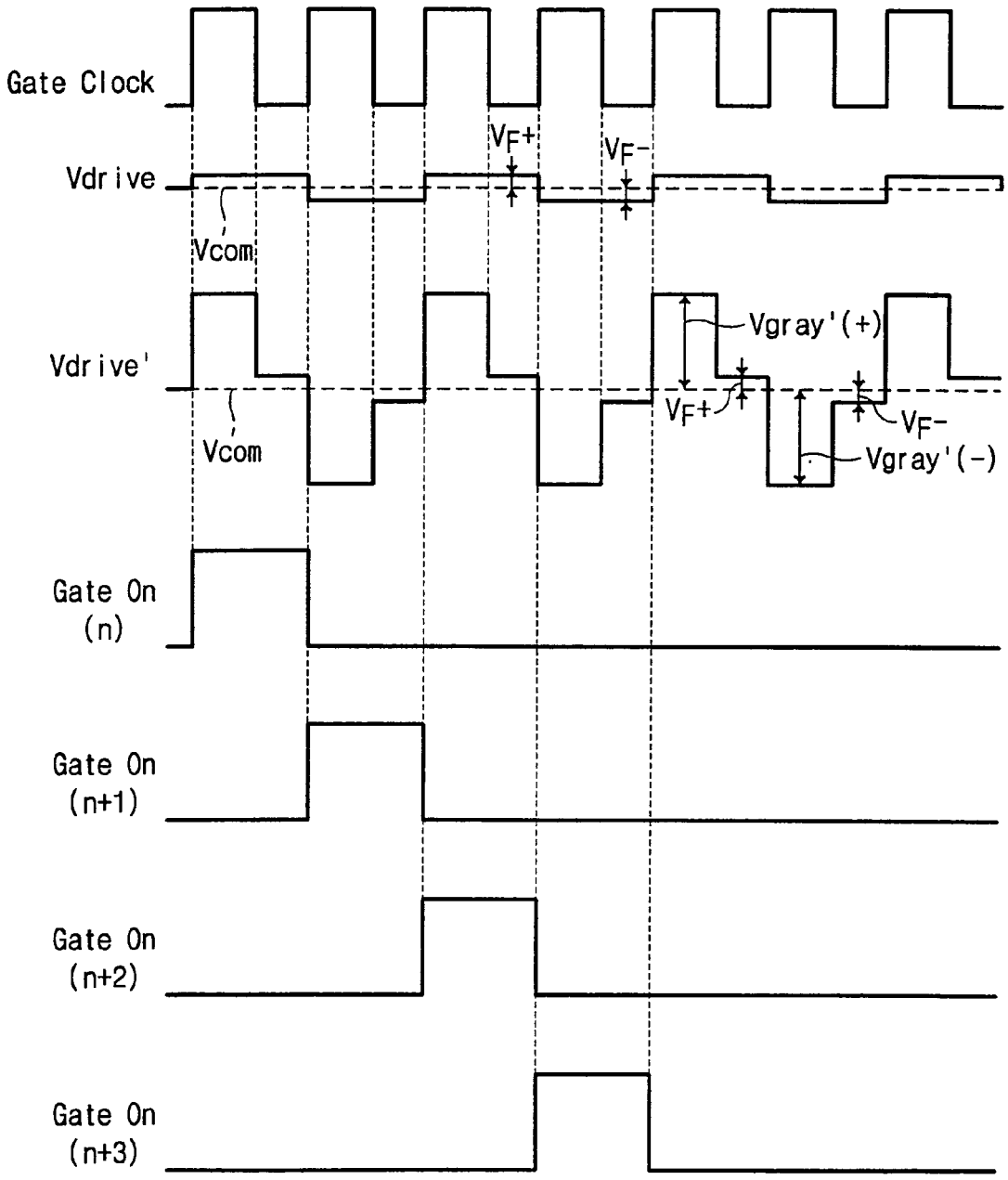
FIGS. 8 and 9 are waveform diagrams showing one example of waveforms of outputs of a source driving circuit, which are generated by applying the gray voltage shown in FIGS. 7A and 7B.
Figure 9:
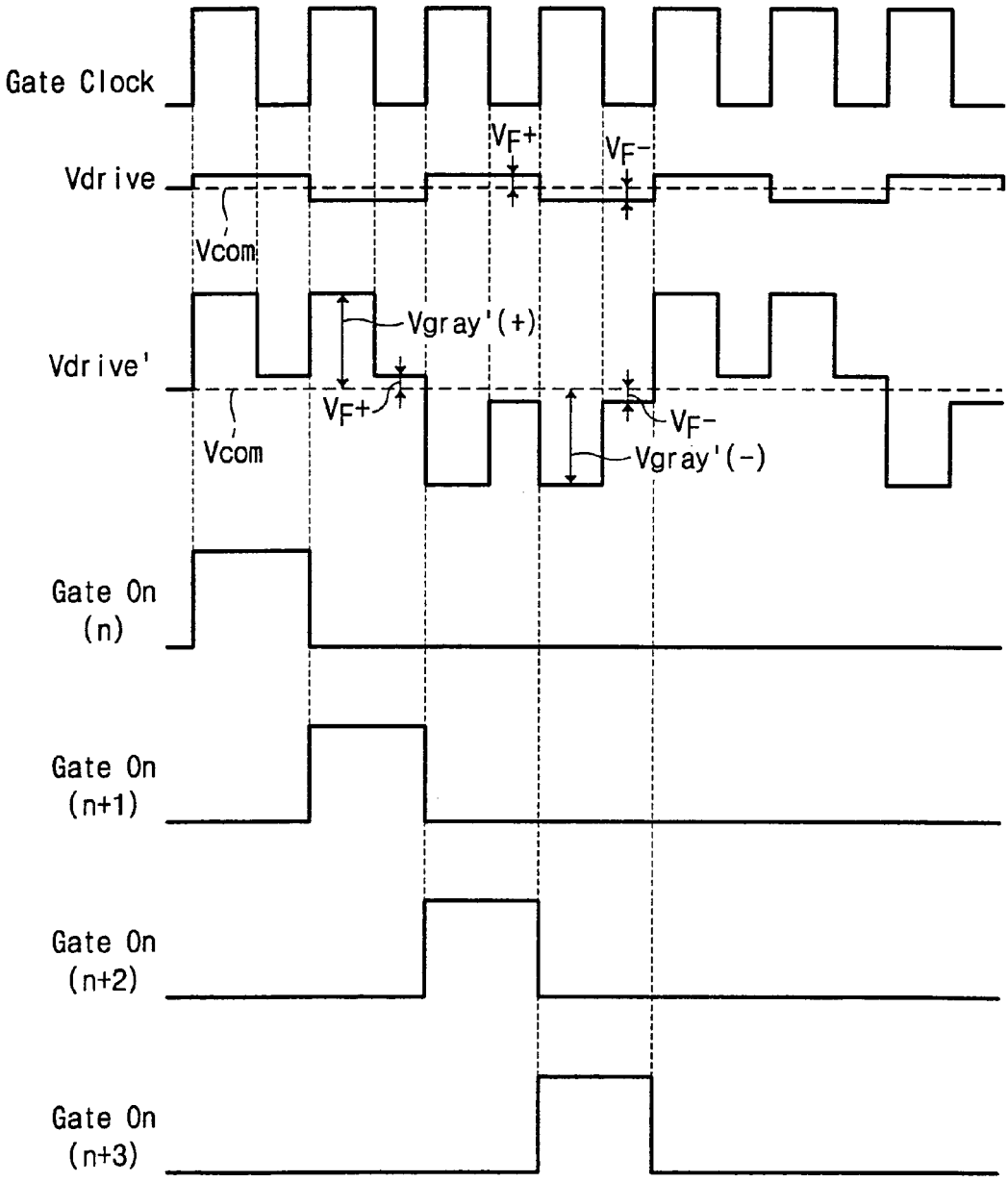

FIGS. 8 and 9 exemplarily illustrate waveforms of outputs of a source driving circuit, which are generated by applying the gray voltage shown in FIGS. 7A and 7B. In particular, FIG. 8 shows a waveform in driving dot inversion, and FIG. 9 shows a waveform in driving 2-line inversion (i.e., normally white mode that white presents when a power is not applied).

In the drawings, illustrated elements are a gate clock signal GATE CLOCK outputted from a timing control circuit 4, an output signal Vdrive of a source driving circuit in a conventional liquid crystal display, an output signal of a source driving circuit 3 in a liquid crystal display according to the present invention, and gate on signals GATE ON(n), GATE ON(n+1), GATE ON(n+2) and GATE On(n+3) that are outputted from the timing control circuit 4 in order to drive (n)th, (n+1)th, (n+2)th and (n+3)th lines.

The source driving circuit in the conventional liquid crystal display generates a liquid crystal driving voltage Vdrive having voltage level of $V_{F+}$ and $V_{F-}$ in each period of the gate clock GATE CLOCK. The voltage Vdrive is symmetric to positive and negative directions on the basis of a common voltage Vcom.

The source driving circuit 3 in the liquid crystal display 100 according to the present invention generates a liquid crystal driving voltage Vdrive'=Vgray(t) that is changed by a gray voltage in each period of the gate clock signal GATE CLOCK. In each period of the gate clock signal GATE CLOCK, the voltage Vdrive' generates a liquid crystal driving voltage Vdrive' having different levels in high and low level intervals. That is, the liquid crystal driving voltage Vdrive'=Vgray'(t) generates positive and negative high voltage that are enough to rapidly charge liquid crystal capacitors Cp constructed in a liquid crystal panel 1. In this case, the liquid crystal driving voltage Vdrive'=Vgray'(t) generates the high voltages only for a predetermined interval, in order to prevent power consumption caused by generating such high voltages.

With reference to FIG. 8, in driving dot inversion, how to drive a positive polarity when applying a gate on signal Gate On(n) for driving an (n)th line, is now explained. If a gate clock signal Gate Clock is laid to high level, a source driving circuit 3 generates a liquid crystal driving voltage Vdrive' having first voltage level that is still higher than that of an existing liquid crystal driving voltage Vdrive. If Gate Clock is laid to low level, the source driving circuit 3 generates a liquid crystal driving voltage Vdrive' having a second voltage level of $V_{F+}$ with the same polarity as Vdrive. In this case, both the first voltage level and the second voltage level are higher than a common voltage Vcom. And, the first voltage level is higher than the second voltage level.

When a gate-on signal Gate On(n) for driving an (n+1)th line is applied, driving a negative polarity is explained. If the gate clock signal Gate Clock is laid to high level, the source driving circuit 3 generates a liquid crystal driving voltage Vdrive' having third voltage level is still lower than that of the existing liquid crystal driving voltage Vdrive. If Gate Clock is laid to low level, the source driving circuit 3 generates a liquid crystal driving voltage Vdrive' having fourth voltage level of $V_{F-}$ with the same polarity as Vdrive. In this case, both values of the third voltage level and the fourth voltage level are lower than the common voltage Vcom And, the third voltage level is lower than the fourth voltage level.

With reference to FIG. 9, in driving 2-line inversion, when a gate on signal Gate On(n) for driving (n)th and (n+1)th lines is applied, driving a positive polarity is explained. If a gate clock signal Gate Clock is laid to high level, a source driving circuit 3 generates a liquid crystal driving voltage Vdrive' whose level is still higher than that of an existing liquid crystal driving voltage Vdrive. If Gate Clock is laid to low level, the source driving circuit 3 generates a liquid crystal driving voltage Vdrive' having voltage level of $V_{F+}$ the same as Vdrive.

When a gate on signal Gate On(n) for driving (n+2)th and (n+3)th lines is applied, driving a negative polarity is explained. If the gate clock signal Gate Clock is laid to high level, the source driving circuit 3 generates a liquid crystal driving voltage Vdrive' whose level is still lower than that of the existing liquid crystal driving voltage Vdrive. If Gate Clock is laid to low level, the source driving circuit 3 generates a liquid crystal driving voltage Vdrive' of $V_{F-}$ with the same polarity as Vdrive.

In FIGS. 7 and 8, output waveforms of the source driving circuit 3 can be changed according to a kind of line driving methods, and are applicable to various kinds of line driving methods (e.g., n-line inversion driving method).

FIGS. 10A, 10B, 11A, 11B, 12A, 12B, 13A and 13B show response speed measuring results of 0 through 32, 0 through 48, 0 through 64, and 32 through 84 gray levels of the source driving circuits by means of the gray voltage shown in FIGS. 7A and 7B. In particular, FIG. 10A, FIG. 10B, FIG. 11A, and FIG. 11B show a response speed of 0 through 32 gray levels of a conventional source driving circuit, a response speed of 0 through 32 gray levels of a source driving circuit according to the invention, a response speed of 0 through 48 gray levels of the conventional source driving circuit, and a response speed of 0 through 48 gray levels of the source driving circuit according to the invention, respectively. FIG. 12A, FIG. 12B, FIG. 13A, and FIG. 13B show a response speed of 0 through 64 gray levels of the conventional source driving circuit, a response speed of 0 through 64 gray levels of the source driving speed according to the invention, a response speed of 32 through 64 gray levels of the conventional source driving circuit, and a response speed of 32 through 64 gray levels of the source driving circuit according to the invention, respectively.

The result can be obtained by measuring the 48-gray voltages ② and ②' and the 64-gray voltages ③ and ③' (see FIGS. 7A and 7B) that were changed and applied with respect to five source driving circuits each having positive and negative polarities. A rising time of each waveform is denoted on the basis of a luminance, and corresponds to a falling time of a liquid crystal based on its movement.

Figure 10A:
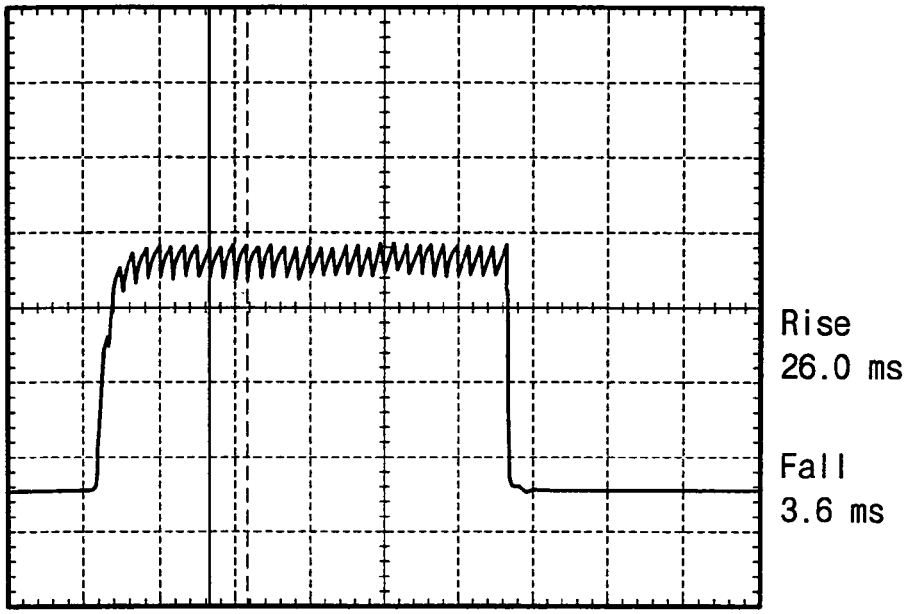
FIGS. 10A, 10B, 11A, 11B, 12A, 12B, 13A and 13B are timing diagrams showing response speed measuring results of 0–32, 0–48, 0–64, and 32–84 grays of the source driving circuits by means of the gray voltage shown in FIGS. 7A and 7B.
Figure 10B:
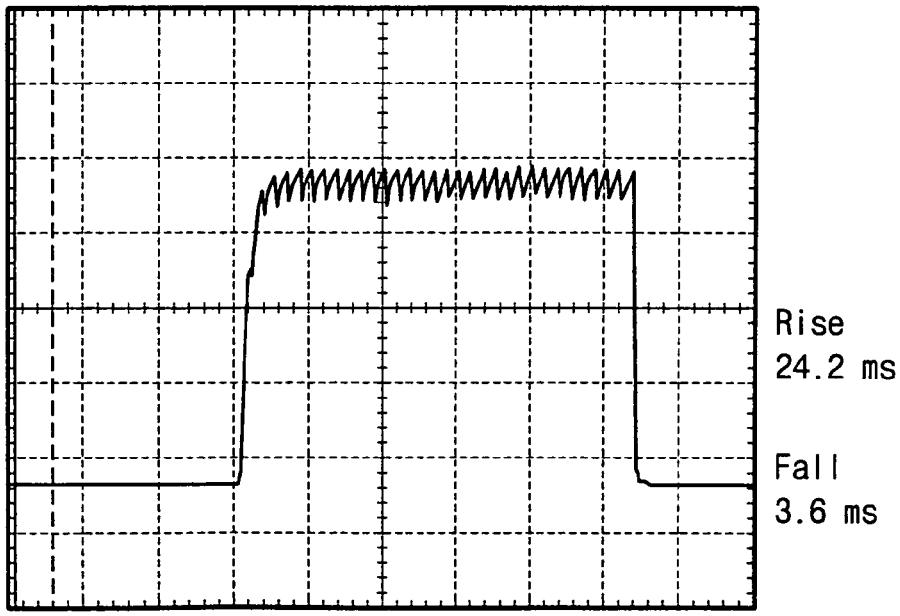

Referring to FIGS. 10A and 10B, in response speeds of a source driving circuit with respect to 0 through 32 gray levels, a conventional rising time (i.e., a falling time of a liquid crystal) is 26.0 ms and a conventional falling time (i.e., a rising time of the liquid crystal) is 3.6 ms. According to the present invention, a rising time (i.e., a falling time of a liquid crystal) is 24.2 ms and a falling time (i.e., a rising time of the liquid crystal) is 3.6 ms. In this case, a luminance-based falling time is not changed, while a luminance-based rising time is reduced from 26 ms to 24.2 ms by 1.8 ms.

Figure 11A:
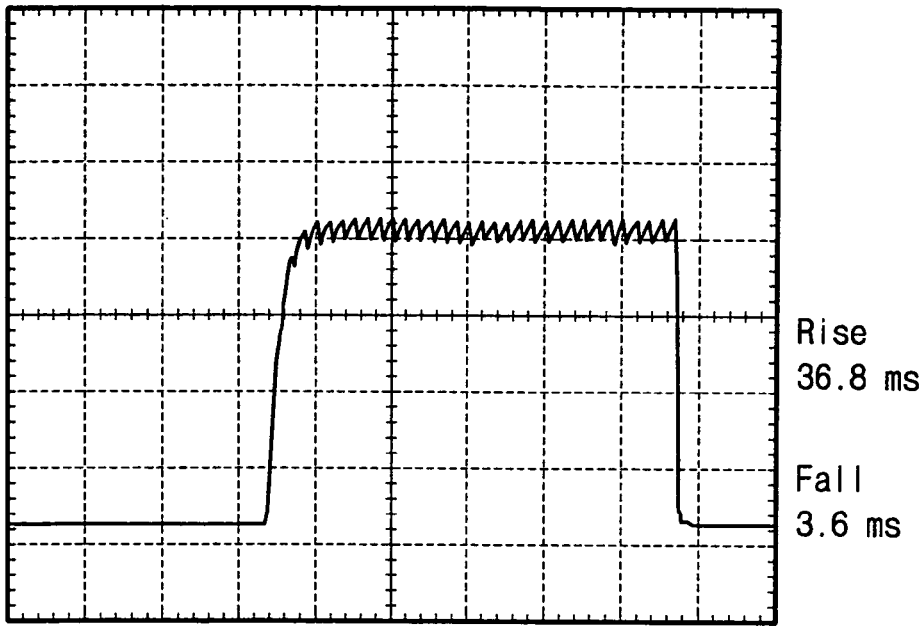
Figure 11B:
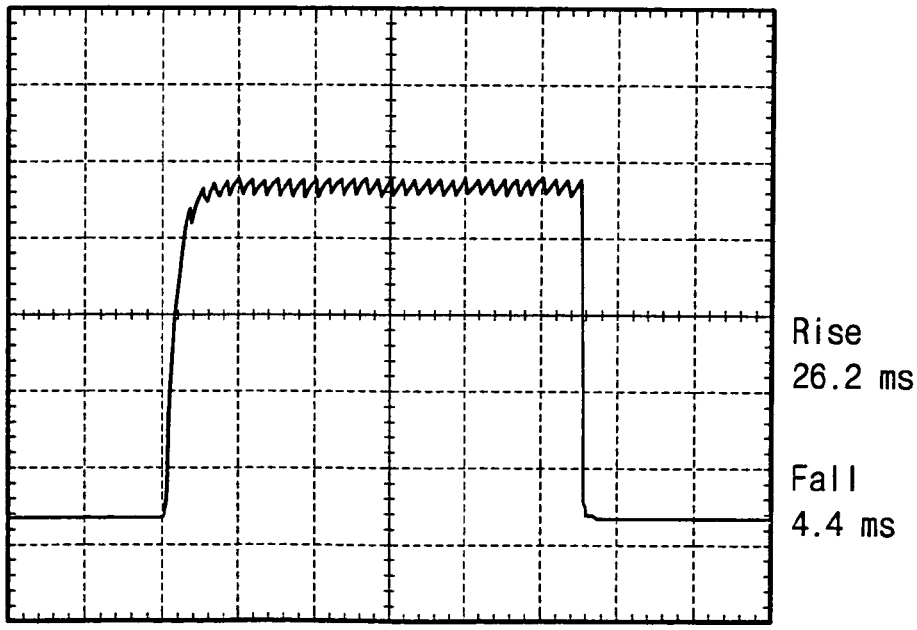

Referring to FIGS. 11A and 11B, in response speeds of a source driving circuit with respect to 0 through 48 gray levels, a conventional rising time (i.e., a falling time of a liquid crystal) is 36.8 ms and a conventional falling time (i.e., a falling time (i.e., a rising time of the liquid crystal) is 3.6 ms. According to the invention, a rising time (i.e., a falling time of a liquid crystal) is 26.2 ms and a falling time (i.e., a rising time of the liquid crystal) is 4.4 ms. In this case, a luminance-based falling time increases in 0.8 ms, while a luminance-based rising is reduced from 36.8 ms to 26.2 ms by 10.6 ms.

Figure 12A:
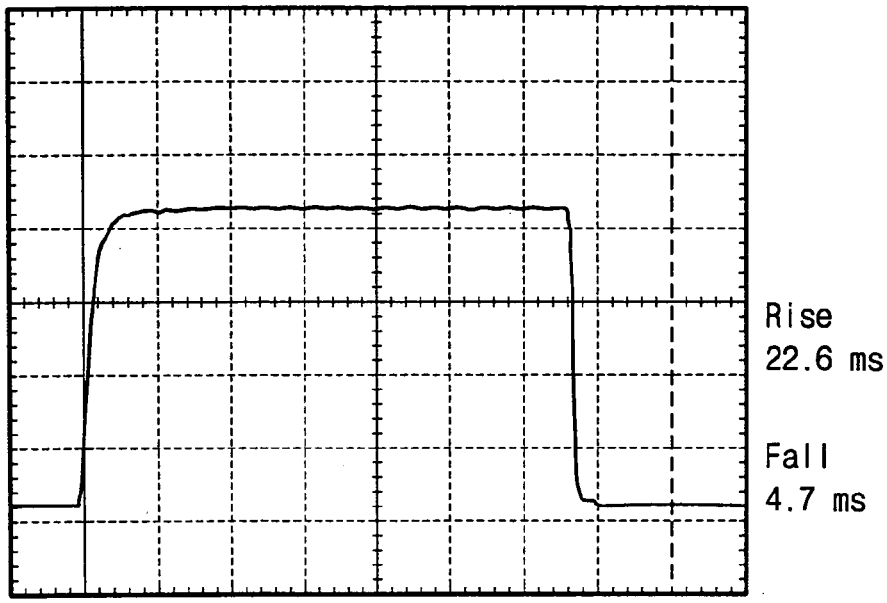
Figure 12B:
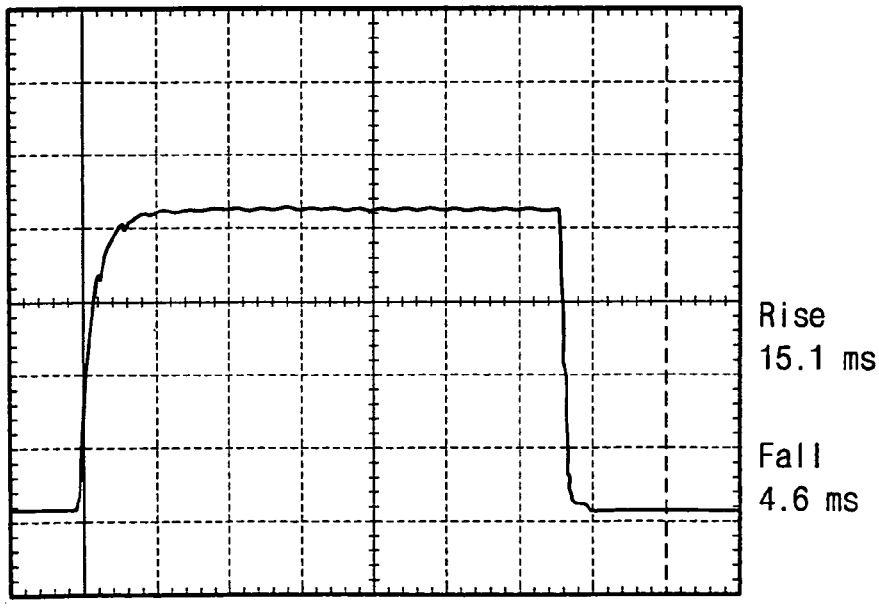

Referring to FIGS. 12A and 12B, in response speeds of a source driving circuit with respect to 0 through 64 gray levels, a conventional rising time (i.e., a falling time of a liquid crystal) is 22.6 ms, and a conventional falling time (i.e., a rising time of the liquid crystal) is 4.7 ms. According to the invention, a rising time (i.e., a falling time of a liquid crystal) is 15.1 ms, and a falling time (i.e., a rising time of the liquid crystal) is 4.6 ms. In this case, a luminance-based falling time is reduced by 0.1 ms, and a luminance-based rising time is reduced from 22.6 ms to 15.1 ms by 7.5 ms.

Figure 13A:
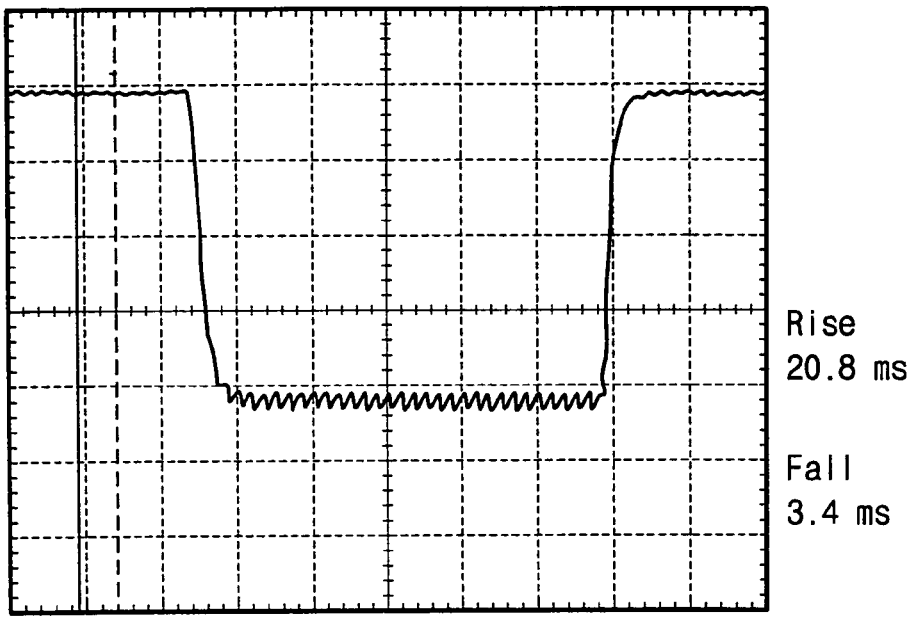
Figure 13B:
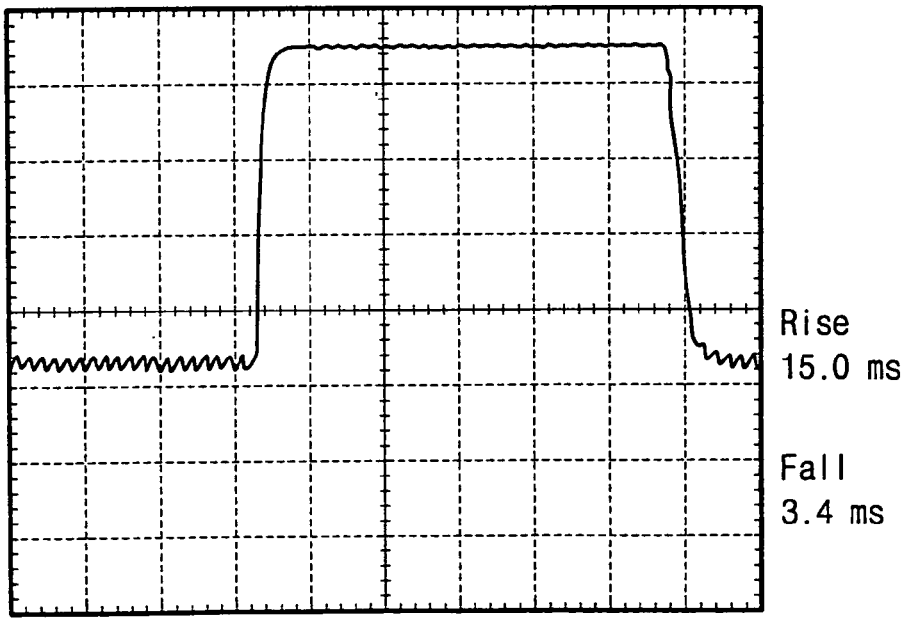

Referring to FIGS. 13A and 13B, in response speeds of 32 through 64 gray levels with respect to a source driving circuit, a conventional rising time (i.e., a falling time of a liquid crystal) is 20.8 ms, and a falling time (i.e., a rising time of the liquid crystal) is 3.4 ms. According to the invention, a rising time (i.e., a falling time of a liquid crystal) is 15.0 ms, and a falling time (i.e., a rising time of the liquid crystal) is 3.4 ms. In this case, a luminance-based falling time is not changed, and a luminance-based rising time is reduced from 20.8 ms to 15.0 ms by 5.8 ms.

In FIGS. 10A through 13B, response speeds of a source driving circuit 3 according to the present invention change as follows. In 0 through 32 gray levels, a response speed is reduced from 26 ms to 24.2 ms by 1.8 ms. In 0 through 48 gray levels, a response speed is reduced from 36.8 ms to 26.2 ms by 10.6 ms. In 0 through 64 gray levels, a response speed is reduced from 22.6 ms to 15.1 ms by 7.5 ms. And, in 32 through 64 gray levels, a response speed is reduced from 20.8 ms to 15.0 ms by 5.8 ms. The following table [TABLE 1] represents these response speeds.

TABLE 1

Falling Times of Liquid Crystal

| | Prior Art | Present Invention |
|---|---|---|
| 0–32 Gray Levels | 26.0 ms (1.00) | 24.2 ms (0.96) |
| 0–48 Gray Levels | 36.8 ms (1.00) | 26.2 ms (0.71) |
| 0–64 Gray Levels | 22.6 ms (1.00) | 15.1 ms (0.67) |
| 32–64 Gray Levels | 20.8 ms (1.00) | 15.0 ms (0.72) |

wherein these falling times are results of simulation that is carried out in the same condition, and numerals in parentheses denote normalized results on the basis of falling times of a conventional liquid crystal, respectively.

Referring to the normalized results in TABLE 1, in 0 through 32 gray levels, the failing time of the liquid crystal is improved by 7%. In 0 through 48 gray levels, the falling time is improved by 29%. In 0 through 64 gray levels, the falling time is improved by 33%. And, in 32 through 64 gray levels, the falling time is improved by 28%. In other words, the speed of the falling time of the liquid crystal is improved in proportion to the gray values.

As described above, a gray voltage generation circuit of this invention outputs an altered gray voltage Vgray' so that a source driving circuit can generate a liquid crystal driving voltage Vdrive' having a voltage level as shown in FIGS. 7 and 8. Thus, the source driving circuit 3 generates a liquid crystal driving voltage Vdrive'=Vgray'(t) that changes according to a gray voltage in each period of a gate clock signal Gate Clock. Liquid crystal capacitors Cp constructed in a liquid crystal panel 1 are rapidly charged by the liquid crystal driving voltage Vdrive' applied from the source driving circuit 3. As a result, a falling time of the liquid crystal is reduced to improve a driving speed of a liquid crystal display.

While an illustrative embodiment of the present invention has been shown and described, numerous variations and alternate embodiments will occur to those skilled in the art, without departing from the spirit and scope of the invention. Accordingly, it is intended that the present invention not be limited solely to the specifically described illustrative embodiment. Various modifications are contemplated and can be made without departing from the spirit and scope of the invention as defined by the appended claims.

What is claimed is:

1. A liquid crystal display (LCD), comprising:

a liquid crystal panel having a plurality of pixels;

a timing control circuit generating a gate clock signal and a plurality of control signals;

a gray voltage generation circuit generating a first gray voltage in a first interval of the gate clock signal and a second gray voltage in a second interval of the gate clock signal in response to a voltage level of the gate clock signal and a plurality of reference voltages obtained by dividing a power supply voltage to a predetermined ratio, the first gray voltage having a magnitude greater than that of the second gray voltage;

a gate driving circuit sequentially scanning the pixels row by row in response to the gate clock signal; and a source driving circuit generating a first driving voltage corresponding to the first gray voltage and a second driving voltage corresponding to the second gray voltage, wherein the first driving voltage is applied to the panel in the first interval of the gate clock signal and the second driving voltage is applied to the panel in the second interval of the gate clock signal.

2. The LCD of claim 1, wherein the source driving circuit, while driving a positive polarity of the panel, generates a driving voltage having a first voltage level in the first interval of the gate clock signal, and generates a driving voltage having a second voltage level in the second interval of the gate clock signal, and both the first voltage level and the second voltage level are higher than a common voltage level, and the first driving voltage level is higher than of the second driving voltage level.

3. The LCD of claim 2, wherein the source driving circuit, while driving a negative polarity of the panel, generates a driving voltage having a third voltage level in the first interval of the gate clock signal, and generates a driving voltage having a fourth voltage level in the second interval of the gate clock signal, and both the first voltage level and the second voltage level are lower than the common voltage level, and the third driving voltage level is lower than the fourth driving voltage level.

4. The LCD of claim 1, wherein the gray voltage generation circuit comprises:

a clock generator generating a plurality of clock signals having a same period as the gate clock signal, in response to the gate clock signal;

a voltage generator dividing the power supply voltage to a predetermined ratio to generate a plurality of voltages as reference for generating the first gray voltage and the second gray voltage; and a gray voltage generator outputting either the first gray voltage or the second gray voltage to the source driving circuit, in response to the gate clock signals issued from the clock generator and the voltages generated by the voltage generator.

5. The LCD of claim 4, wherein the voltage generator includes n-bit voltage generation units for dividing the power supply voltage to a predetermined ratio to generate the n-bit voltages each having different voltage level, and wherein each of the voltage generation unit includes at least two and more resisters coupled between the power supply voltage and a ground voltage, and an output terminal coupled to one of contact points between the resisters.

6. The LCD of claim 4, wherein the clock generator comprises:

an input terminal for receiving the gate clock signal;

n-bit clock generation units coupled to the input terminal in parallel; and n-bit output terminals each being coupled to the n-bit clock generation units, wherein each of the clock generation units has a capacitor and a resister that are serially connected between the input terminal and the output terminal, and generates a clock signal having a same period as the gate clock signal.

7. The LCD of claim 4, wherein the gray voltage generator comprises:

a positive gray voltage generation unit for generating (m/2)-bit positive first and second gray voltages having a same polarity as the gate clock signal and each having different voltage level in the first interval and the second interval of the gate clock signal so as to drive a positive polarity of the panel; and a negative gray voltage generation unit for generating (m/2)-bit negative first and second gray voltages having a polarity opposite to the gate clock signal and each having different voltage level in the first interval and the second interval of the gate clock signal so as to drive a negative polarity of the panel.

8. The LCD of claim 7, wherein the positive gray voltage generation unit includes at least one or more amplifier circuits having a first input terminal for receiving one of the n-bit clock signals from the clock generator and one of the n-bit reference voltages from the voltage generator, a second input terminal connected to a ground through a resister, and an amplifier circuit having a feedback resister connected between the second input terminal and the output terminal.

9. The LCD of claim 8, wherein the amplifier circuit adds the clock signal to the reference voltage, and amplifies the same to generate the positive first and second gray voltages.

10. The LCD of claim 8, wherein the amplifier circuit further includes a resister for dividing the positive first and second gray voltages, and an output terminal connected to the contact point of the resister, for outputting the divided gray voltage.

11. The LCD of claim 7, wherein the negative gray voltage generation unit includes a first input terminal for receiving one of the n-bit reference voltages from the voltage generator, a second input terminal for receiving one of the n-bit clock signals from the clock generator, and an amplifier circuit having a feedback resister connected between the second input terminal and the output terminal.

12. The LCD of claim 11, wherein the amplifier circuit subtracts the clock signal from the reference voltage, and amplifies it to a predetermined ratio to generate the negative first and second gray voltages.

13. The LCD of claim 11, wherein the amplifier circuit further includes a resistor for dividing the negative first and second gray voltages, and an output terminal to the contact point of the resistor, for outputting the divided gray voltage.

* * * * *